United States Patent [19]

Townes, Jr. et al.

[11] 3,964,071

[45] June 15, 1976

[54] RADAR ANTENNA HAVING A SCREEN SUPPORTED BY SHAPED SLATS

[75] Inventors: William E. Townes, Jr., Irving; Stanley P. Svedeman, Richardson, both of Tex.

[73] Assignee: Texas Instruments Incorporated, Dallas, Tex.

[22] Filed: Mar. 11, 1975

[21] Appl. No.: 557,442

Related U.S. Application Data

[62] Division of Ser. No. 420,196, Nov. 28, 1973, Pat. No. 3,886,557.

[52] U.S. Cl. ..... 343/840; 343/912

[51] Int. Cl.[2] ..... H01Q 15/16

[58] Field of Search ..... 343/840, 912, 915, 916

[56] References Cited

UNITED STATES PATENTS

| | | | |
|---|---|---|---|
| 2,423,648 | 7/1947 | Hansell | 343/840 |
| 2,540,518 | 2/1951 | Cluyas | 343/840 |
| 2,703,842 | 3/1955 | Lewis | 343/840 |
| 3,383,693 | 5/1968 | Kahn et al. | 343/915 |

*Primary Examiner*—Eli Lieberman

*Attorney, Agent, or Firm*—Harold Levine; Rene' E. Grossman; Alva H. Bandy

[57] ABSTRACT

The specification discloses a radar antenna which is fabricated by forming a plurality of elongated flat ribs each having an inwardly curved forward edge. Slots extending normally from the forward or rearward edge are formed along the length of each of the ribs. A plurality of the ribs are oriented vertically and the slots therein are mated with the slots in a plurality of the ribs which are disposed horizontally. The vertical and horizontal ribs are thus interconnected in a rigid lattice network which defines a plurality of rectangular compartments. The inwardly curved forward edges of the ribs in the lattice network define a contoured shape for an antenna reflecting surface. A screen is attached over the forward edges in order to provide a reflecting surface on the radar antenna.

11 Claims, 10 Drawing Figures

RADAR ANTENNA HAVING A SCREEN SUPPORTED BY SHAPED SLATS

This is a division, of application Ser. No. 420,196, filed Nov. 28, 1973, now Pat. No. 3,886,557.

FIELD OF THE INVENTION

This invention relates to radar antennas, and more particularly relates to a radar antenna of a unique structural design which may be simply and economically fabricated.

THE PRIOR ART

Radar antennas have been previously fabricated by bending pieces of metallic tubing about stationary tooling to the desired shape and then welding the aluminum tubing into a unitary network. Welding of such tubes has often caused expansion and distortion of the tubes, thereby causing variance in the desired shape of the antenna. Moreover, the tubes have generally been manually bent and fabrication has thus been expensive and time consuming. Further, it has been heretofore difficult to construct a plurality of substantially identical radar antennas on an assembly line basis. A need has thus arisen for a technique for fabricating radar antennas which is economical and which is not dependent upon a substantial aount of manual operations, thereby resulting in radar antennas which may be reproducible on an assembly line basis.

SUMMARY OF THE INVENTION

In accordance with the present invention, a radar antenna reflector assembly and a method of fabricating same is provided which substantially eliminates or reduces many of the problems heretofore associated with prior radar antenna fabricating techniques.

In accordance with the present invention, a radar antenna reflector assembly is provided which includes a first set of spaced apart parallel flat ribs interlocked with a second set of spaced apart flat ribs in order to form a rigid lattice network. The forward edges of the ribs mate to define an inwardly contoured reflecting surface. The forward edges of the ribs may be formed utilizing numeric control punching techniques.

In accordance with another aspect of the invention, a radar antenna reflector assembly includes a plurality of elongated ribs each having a width substantially greater than the thickness thereof, a first portion of the ribs being disposed with the widths in parallel horizontal planes and spaced apart one above the other. A second portion of the ribs are disposed in parallel spaced apart vertical planes. The first and second portions of the ribs are interconnected such that the edges of the ribs define a curved antenna reflecting surface.

In accordance with yet another aspect of the invention, a radar antenna reflector assembly is provided which includes a plurality of horizontally oriented elongated flat ribs. A plurality of slots are spaced apart along a first edge of each of the horizontal ribs. A plurality of vertically disposed elongated flat ribs also include a plurality of slots spaced apart along a second edge thereof. The slots of the horizontal ribs receive the slots of the vertical ribs to rigidly interconnect the ribs in a lattice network which defines a plurality of rectangular compartments. The forward edges of the ribs are flush and are inwardly curved such that the lattice network defines a contoured antenna reflecting surface. A screen is attached over the reflecting surface to provide a radar antenna.

In accordance with yet another aspect of the invention, a method of forming an inwardly curved edge of an antenna assembly flat rib includes positioning the rib in a punch press having a circular punch. The rib is then incremented to a plurality of predetermined positions relative to the circular punch. The edge of the rib is punched with the circular punch at each of the predetermined positions to thereby form a plurality of adjoining cutout arcs defining the prescribed inwardly curved edge.

In accordance with yet another aspect of the invention, a method of assembling a radar antenna reflector assembly includes forming a plurality of elongated flat ribs each having a concave edge. A plurality of slots are then formed which extend inwardly from an edge of each of the slots. The slots of a plurality of horizontally disposed ribs are interfitted with the slots of a plurality of vertically disposed ribs to form a rigid lattice network, the concave edges of the ribs in the lattice network thereby forming a curved antenna reflecting surface.

DESCRIPTION OF THE DRAWINGS

For a more complete understanding of the present invention and for further objects and advantages thereof, reference is now made to the following description taken in conjunction with the accompanying Drawings, in which.

DESCRIPTION OF THE PREFERRED EMBODIMENT

Figure 1:
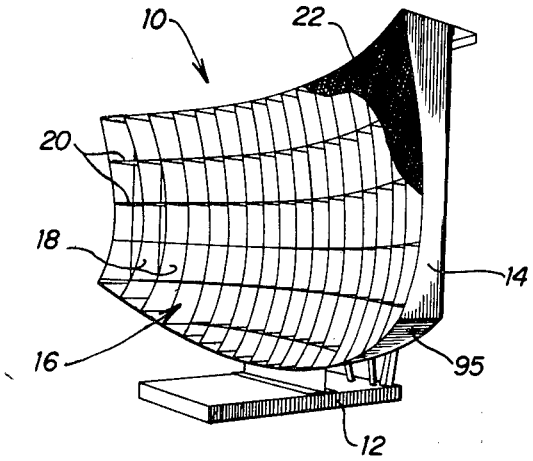
FIG. 1 is a perspective front view, partially broken away, of a radar antenna constructed in accordance with the present invention.

FIG. 1 illustrates a radar antenna assembly identified generally by the numeral 10 and including a rectangular base 12 which supports a rigid outer frame assembly 14. A rigid lattice network 16 comprises a plurality of vertically extending ribs 18 which are rigidly interconnected with a plurality of horizontally extending ribs 20 to form a plurality of rectangular compartments. The forward edges of the interconnected ribs 18 and 20 mate with one another and are curved to define an inwardly contoured antenna reflecting surface. A metal screen 22 is tack-welded over the forward edges of the interconnected ribs to form the contoured reflecting surface of the radar antenna.

Figure 2:
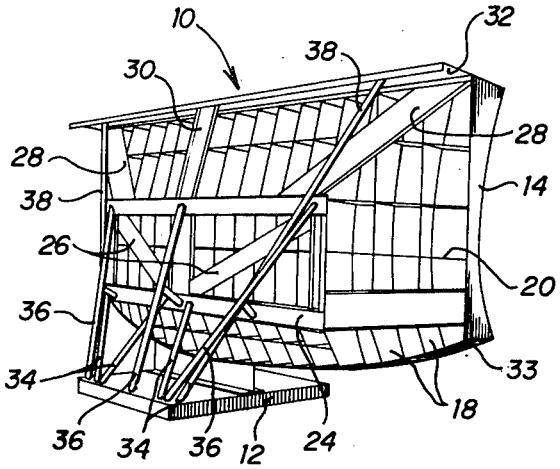
FIG. 2 is a perspective rear view of the antenna shown in FIG. 1.

FIG. 2 illustrates the rear view of the antenna 10 and illustrates the support bracing for the antenna. A generally rectangular support member 24 is attached by welding to the rear of the rigid lattice network 16 and includes cross braces 26 for strength. Diagonal brace members 28 extend upwardly from the rectangular support member 24, as also does a vertical support member 30. The outer frame assembly 14 includes a rearwardly overhanging channel 32 attached to the top of the vertical ribs.

Four angled short support struts 34 extend from the base 12 to the lower portion of the rectangular support member 24. Three intermediate length struts 36 extend from the base 12 to the upper portion of the rectangular member 24. Two elongated struts 38 extend from the base 12 to the underside of the channel 32 for additional support thereof. In the preferred embodiment, the entire antenna assembly is constructed from light weight metal such as aluminum. The various supports, braces and struts are attached by means of welding.

Figure 3:
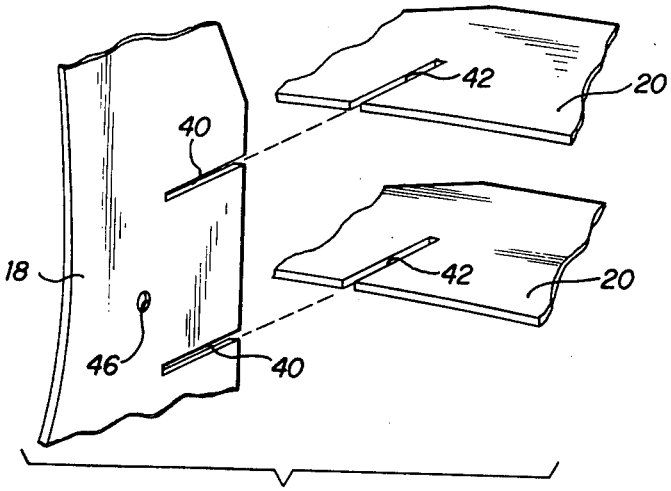
FIG. 3 is an exploded view of portions of a vertical rib and two horizontal ribs of the present antenna.
Figure 4:
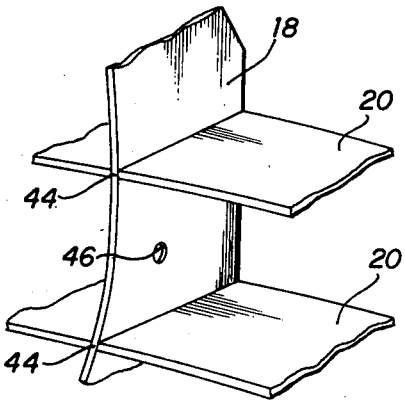
FIG. 4 is a perspective view illustrating the interconnection of the ribs shown in FIG. 3.

FIGS. 3 and 4 illustrate the interconnection of the horizontal and vertical ribs to form the rigid lattice network of the invention. As shown in FIG. 3, each of the vertical ribs 18 are constructed from flat elongated pieces of metal each having a width substantially greater than the thickness thereof. A plurality of slots 40 extend from the rear edge of the vertical ribs 18 inwardly to the midpoint of the ribs. In addition, each of the horizontal ribs 20 include slots 42 formed along the length thereof and which extend from the forward edge of the ribs inwardly to the midpoint of the ribs.

As will be subsequently described, in assembly the slots 40 of the ribs 18 are interconnected with the slots 42 in the ribs 20 to form an interconnected assembly as shown in FIG. 4. Due to the fact that the slots 40 and 42 extend to the midpoint of the ribs, the forward edges of the ribs 18 and 20 are flush at the juncture point 44. This interconnection also allows for ease of quality control checking, as a misalignment of the ribs may be easily detected by sight or by feel at the juncture point 44. After interconnection in the manner shown in FIG. 4, the ribs are tack-welded in order to permanently attach the ribs to one another to form a rigid lattice network. Apertures 46 are formed through the vertical ribs 18 for receiving support tooling during assembly.

Figure 5:
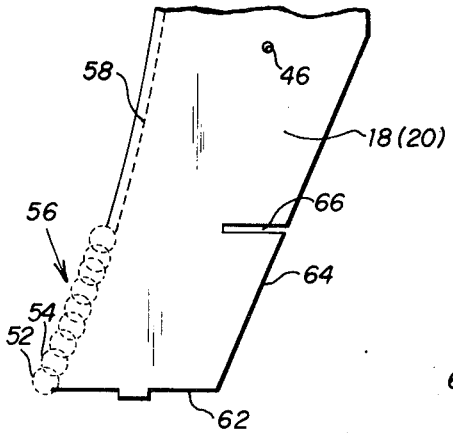
FIG. 5 is a somewhat diagrammatic view illustrating the fabrication of the curved forward edge of a rib.

FIG. 5 illustrates the formation of the concave curved forward edges of the vertical and horizontal ribs 18 and 20. The ribs 18 and 20 are initially attached within a numeric controlled punch press such as a Wiedematic punch press having a two inch diameter circular punch. As is known, such numeric controlled punch presses move a work piece under the control of a punched paper tape or the like to desired locations beneath the circular punch and automatically punches at the desired location. According to the present invention, each rib 18 and 20 is incremented to a plurality of desired locations beneath the punch and is punched in order to define the desired contoured surface.

For example, as shown in FIG. 5, the two inch diameter punch is initially operated to punch at position 52 and then the rib 18 is incremented to a second position 54 and the rib is again punched. Similarly, the rib is punched at a plurality of successive positions indicated by the dotted circles identified generally by the arrow 56. The numerically controlled punch press is controlled such that the contour identified generally by the dotted line 58 is punched out along the length of the rib.

Figure 6:
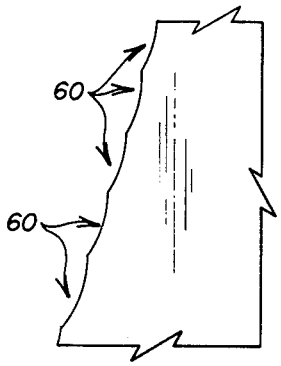
FIG. 6 is a view, partially broken away, of the rib of FIG. 5 illustrating the adjoining arcs formed by the punch press fabrication technique.

FIG. 6 illustrates an enlarged view of a portion of rib 18 illustrating how the desired contour is formed by a plurality of successive adjoining cutout arcs 60. This results in a somewhat rippled curved surface which may, if desired, be smoothed by conventional means. However, it may be seen that by proper selection of the distance between successive punches and of the diameter of the circular punch, the rippled surface formed by the punch press may be controlled to provide the desired degree of smoothness without the requirement of additional smoothing steps. After the punching process, the end and rear edges 62 and 64 of the rib may be sheared to size. The slot 66 may be formed in the rib by use of the numeric controlled punch press. In the preferred embodiment, the ribs are formed from one-eighth inch thick aluminum alloy sheets.

As previously noted, the number of circular punches utilized to form the desired forward edge contour may be varied. However, in a practical embodiment, it has been found that one-half of a horizontal rib may be provided with the desired contour with 227 successive punches. Two halves of a rib formed by this technique are then welded together to form the desired unitary rib. The following Table I illustrates successive increments in inches in the X and Y coordinates for a two inch diameter punch utilized in the numeric controlled Wiedematic punch press to form a portion of a horizontal rib according to the invention.

TABLE I

| No. | WDMT X | WDMT Y | No. | WDMT X | WDMT Y |
|---|---|---|---|---|---|
| 1 | 0.31895 | 22.16174 | 2 | 0.58035 | 22.07445 |
| 3 | 0.84175 | 21.98753 | 4 | 1.10315 | 21.90100 |
| 5 | 1.36455 | 21.81480 | 6 | 1.62595 | 21.72913 |
| 7 | 1.88734 | 21.64378 | 8 | 2.14874 | 21.55882 |
| 9 | 2.41014 | 21.47424 | 10 | 2.67154 | 21.39006 |
| 11 | 2.93294 | 21.30624 | 12 | 3.19434 | 21.22285 |
| 13 | 3.45573 | 21.13985 | 14 | 3.71713 | 21.05722 |
| 15 | 3.97853 | 20.97498 | 16 | 4.23993 | 20.89314 |
| 17 | 4.50133 | 20.81171 | 18 | 4.76273 | 20.73062 |
| 19 | 5.02412 | 20.64995 | 20 | 5.28552 | 20.56966 |
| 21 | 5.54692 | 20.48976 | 22 | 5.80832 | 20.41026 |
| 23 | 6.06972 | 20.33113 | 24 | 6.33112 | 20.25241 |

Figure 7:
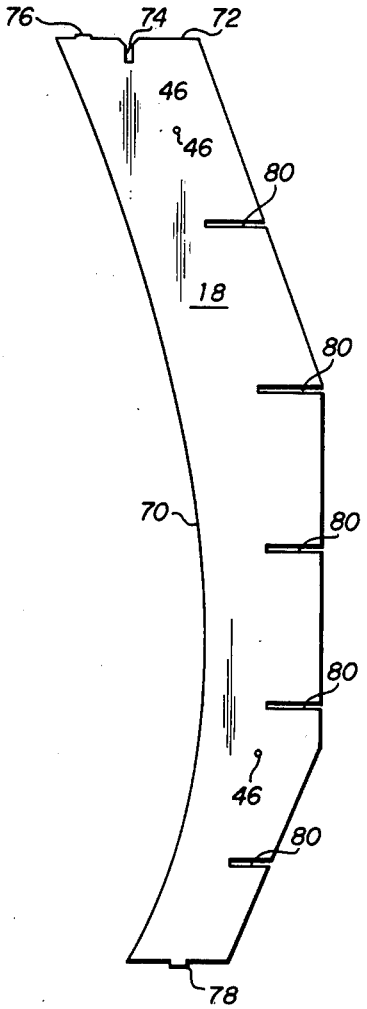
FIG. 7 is a side view of one of the vertical ribs of the antenna.

FIG. 7 illustrates a side view of a completed vertical rib 18 formed in accordance with the invention. It will of course be understood that the various ribs will differ in configuration in order to define the parabolic shape. The forward edge 70 is provided with a concave parabolic curve which is formed by the punching technique described with respect to FIGS. 5 and 6. The upper edge 72 of the rib includes a slot 74 for receiving the edges of top channel members in the manner to be subsequently described. A tab 76 is formed on the upper portion of the rib 68 and a tab 78 is formed on the bottom thereof. These tabs are received by slots formed in the upper and lower frame members in order to support the ribs in the desired position during assembly. A plurality of horizontal slots 80 are formed at spaced apart locations along the length of the rib and extend generally normally from the rear surface to the midpoint of the rib. Due to the varying width of the rib, the length of various ones of the slots are different.

An important aspect of the present invention is that, with the use of the numeric controlled machine fabrication technique, manual bending of tubular members is eliminated. The numeric controlled punching technique enables a plurality of ribs to be quickly and efficiently formed on a mass production basis. The tolerances provided by the present machine enable high quality control to be accomplished and results in interchangeable pieces to enable a plurality of substantially identical antennas to be constructed. for example, typical manufacturing contour tolerances at the forward surface of the present antenna are ± 0.09 inches at the center zone, ± 0.12 inches at the inner wing zone and ± 0.15 inches at the outer wing zone. Due to the close control of the positioning of the slots 80 with respect to the contoured surface 70, the assembly is generally self locating and thus may be quickly assembled prior to welding.

Figure 8:
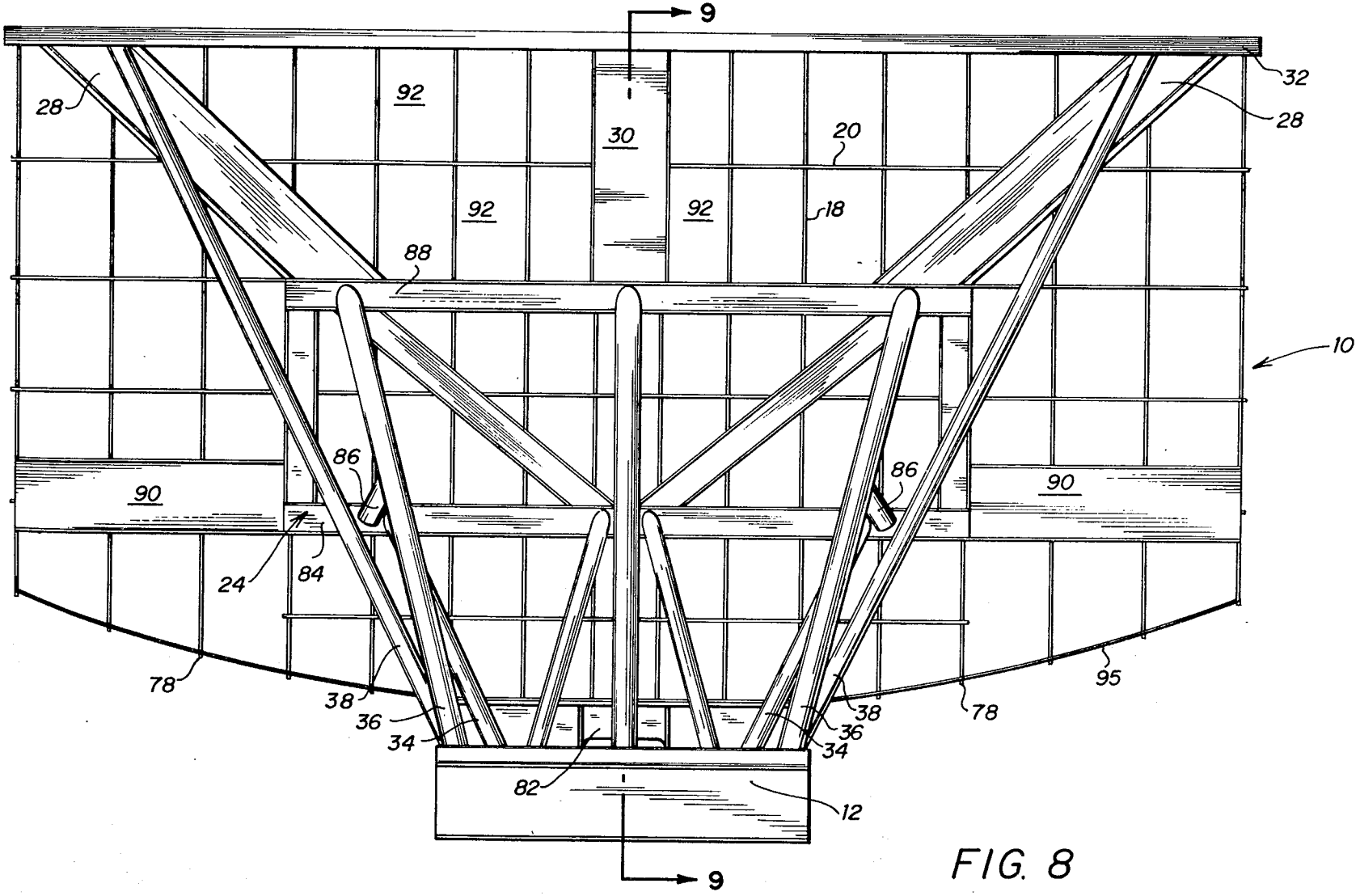
FIG. 8 is a rear elevational view of the antenna.

FIG. 8 illustrates a rear view of the final antenna assembly in greater detail. The base 12 includes an upward extension 82 which comprises an I-beam to provide support to the underside of the antenna body. The struts 34, 36 and 38 angle upwardly from the base 12 in the manner previously described. The upper portions of struts 34 are welded to rigid frame member 84 which forms a portion of a rectangular rear support member 24 previously described. In addition, the struts 36 include extensions 86 which are welded to the frame member 84. The upper portions of the struts 36 are welded to a support member 88 which also forms a portion of the rectangular support member 24. The struts 38 are rigidly connected between the base 12 and the overhanging channel 32. Braces 28 and horizontal braces 90 provide additional strength to the antenna assembly.

As shown in FIG. 8, the vertical ribs 18 and interlocking horizontal ribs 20 form a plurality of rectangular compartments 92. This rectangular network configuration provides an extremely stiff structure in the direction normal to the reflecting antenna surface contour. The rectangular compartment configuration alos allows a substantial amount of resistance to distortion during welding steps for assembly and attachment of the screen 22 (FIG. 9) to the ribs.

Figure 9:
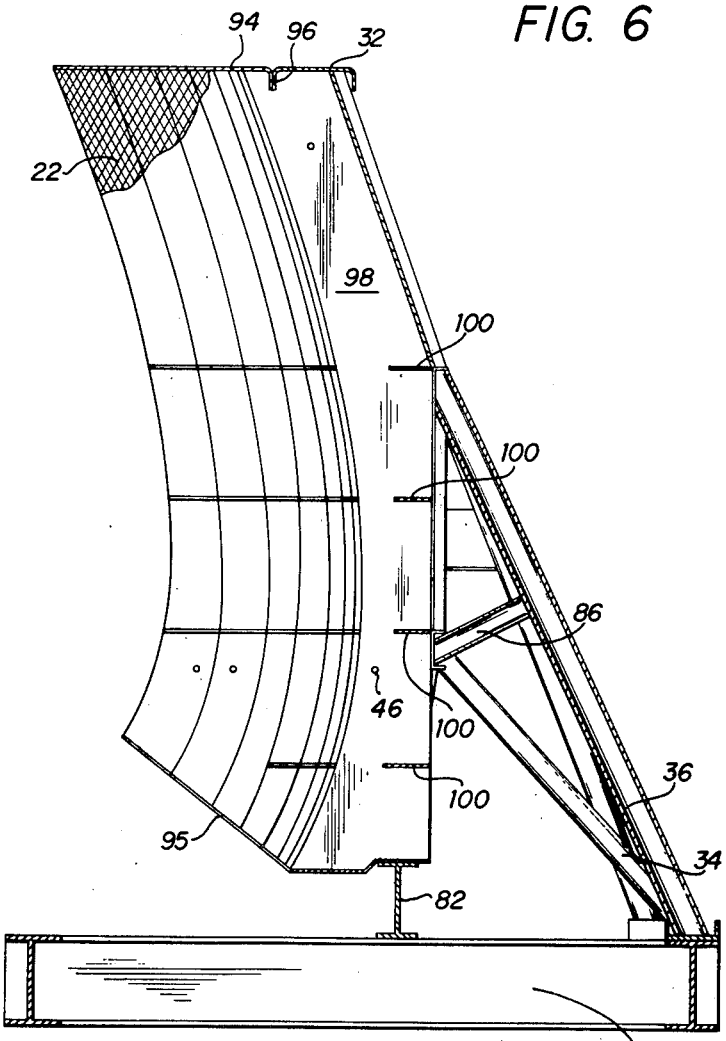
FIG. 9 is a sectional view taken generally along section lines 9—9 in FIG. 8.

FIG. 9 illustrates a main upper channel 94 and the rearwardly overhanging channel 32. The edges 96 of the channels fit within the slot 74 in the ribs as shown in FIG. 7. FIGS. 8 and 9 illustrate the lower curved plate 95 receiving the tabs 78 of the vertical ribs 18. FIG. 9 illustrates the interconnection of a vertical rib 98 with a plurality of horizontal ribs 100 and illustrates how the various vertical and horizontal ribs of the invention have varying configurations at both the forward and rear edges in order to provide the desired contoured parabolic reflecting surface. The screen 22 may comprise a solid metallic layer or may comprise a metallic screen made from expanded metal such as 6061 aluminum. The screen 22 is tack-welded onto the forward edges of the lattice network. It will be understood that the reflecting antenna surface provided by the invention may have a variety of curvatures, but generally the reflecting configuration will be an aberated parabola.

Figure 10:
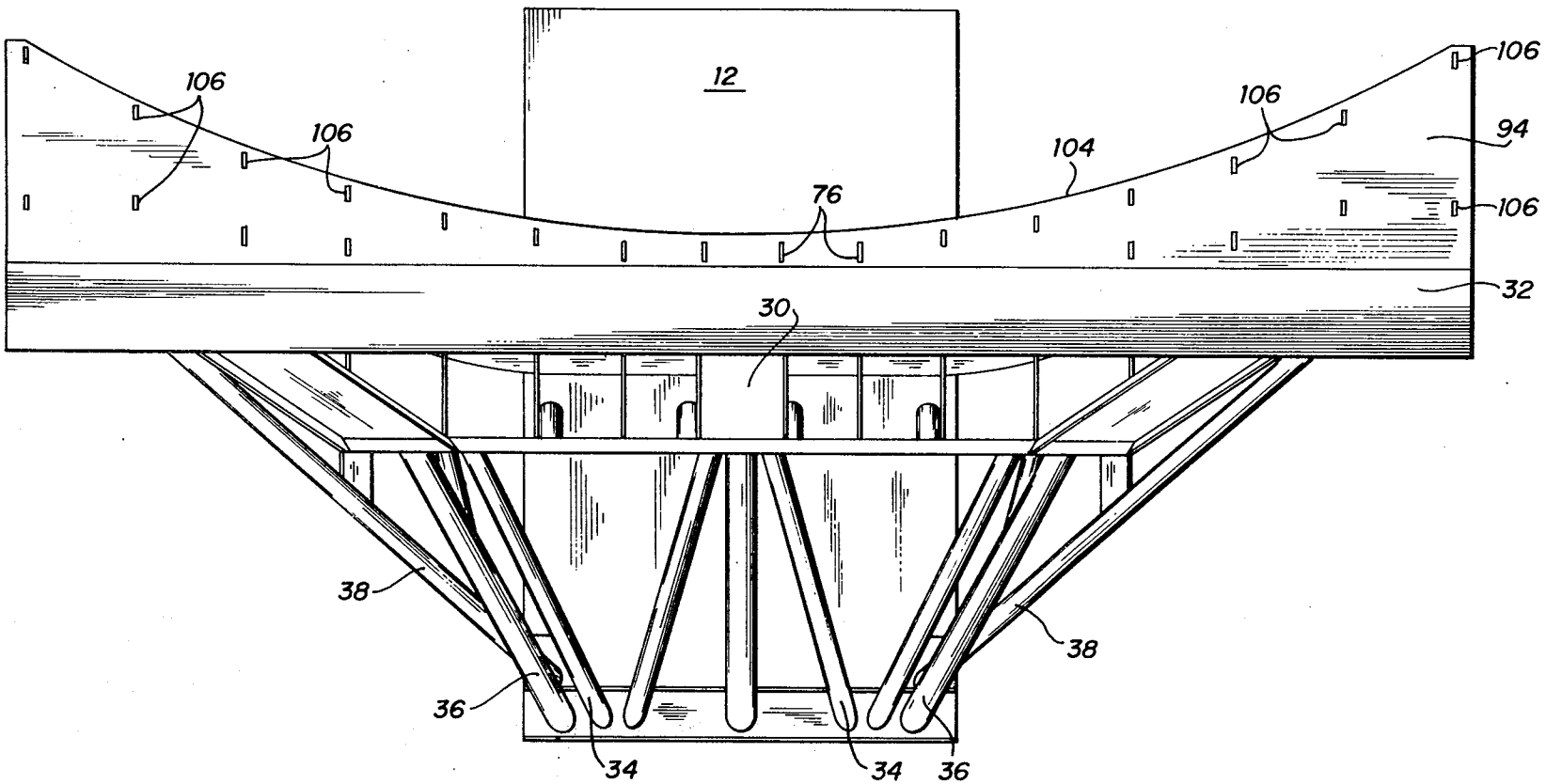
FIG. 10 is a top view of the present antenna.

FIG. 10 illustrates a top view of the present antenna and illustrates the upper channel 94 which has a concave surface 104. The channel 94 includes a plurality of slots 106 which receive the tabs 76 of the vertical ribs. FIG. 10 also illustrates a top view of the connection of the struts 34–38.

The fabrication technique for the antenna includes initially forming the vertical and the horizontal ribs as previously noted. The back support structure is then fabricated and welded into several sub-assemblies. The vertical ribs are then loaded into an assembly tooling fixture. Rib to rib alignment is maintained through use of support tooling pins which are inserted through the holes 46 (FIG. 3) punched through the ribs. The horizontal ribs are then slipped into the slots of the vertical ribs as shown in FIGS. 3 and 4. The desired rib alignment is maintained by virtue of the close slot tolerance provided by the numeric punching techniques.

As previously noted, the interconnected horizontal and vertical ribs should be flush at the juncture point 44 (FIG. 4) and any misalignments may be easily detected at the point in the fabrication and corrected. The upper channels and lower plate are then positioned on the tabs 76 and 78 (FIG. 7) of the vertical ribs and are then welded into place. In some instances, it may be desired to initially position center portions of the horizontal ribs and then to insert wing tip sections and butt weld the wing tip sections to the center portions. The back support structure is then positioned into place on the assembly fixture and welded into place. The screen 22 is then positioned and tack-welded into place. The radar antenna is then painted and is ready for use.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. A radar antenna comprising:

a first set of spaced apart parallel flat ribs interlocked with a second set of spaced apart flat ribs, said first and second sets of ribs extending at an angle to one another to form a rigid lattice network, the forward edges of said ribs defining an inwardly contoured support surface for a reflecting surface, and screen means attached to the inwardly contoured support surface for forming an antenna reflector.

2. The radar antenna assembly of claim 1 wherein said first set of ribs extend generally horizontally and said second set of ribs extend generally vertical.

3. A radar antenna comprising:

a plurality of elongated ribs each having a width substantially greater than the thickness thereof and forward edges contoured for forming a reflector surface, a first portion of said ribs being disposed with said widths in parallel horizontal planes and spaced apart one above the other, a second portion of said ribs being disposed in parallel spaced apart vertical planes, said first and second portions of said ribs being interconnected such that the forward edges of said ribs define a curved support surface for an antenna reflecting surface, and a screen attached to the curved support surface for forming the screen into a radar reflector.

4. The radar antenna of claim 3 wherein said ribs are interconnected by interfitting slots formed in said ribs.

5. The radar antenna of claim 3 wherein the forward edges of interconnected ribs are flush with one another.

6. The radar antenna of claim 3 and further comprising:

a base supporting said interconnected ribs, bracing struts extending between said base and the rear of said interconnected ribs, and an upper housing member overhanging the rear of said interconnecting ribs, and braces connected between said base and the overhanging portion of said upper housing member.

7. The radar antenna of claim 3 and further comprising apertures formed through ones of said ribs for receiving support tooling during assembly of said ribs.

8. A radar antenna comprising:

a plurality of horizontally oriented elongated flat ribs, a plurality of slots spaced apart along an edge of each of said horizontal ribs, a plurality of vertically disposed elongated flat ribs, a plurality of slots spaced apart along an edge of each of said vertical ribs, the slots of said horizontal ribs receiving the slots of said vertical ribs to rigidly interconnect said ribs in a lattice network defining a plurality of rectangular compartments, the forward edges of said ribs being inwardly curved such that said lattice network defines a contoured shape on which may be formed an antenna reflecting surface, and screen means attached over the contoured forward edges to form an antenna reflector surface of a preselected configuration.

9. The radar antenna of claim 8 wherein said reflecting surface has a parabolic configuration.

10. The radar antenna of claim 8 wherein ones of said ribs include tabs on the end thereof, and further including holding means including slots for receiving said tabs.

11. The radar antenna of claim 8 wherein said interconnected ribs are welded together.

* * * * *